US010709639B2

(12) United States Patent
Hirano et al.

(10) Patent No.: US 10,709,639 B2
(45) Date of Patent: Jul. 14, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Azusa Hirano, Yokohama (JP); Yasutsugu Tsuruoka, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 16/059,097

(22) Filed: Aug. 9, 2018

(65) Prior Publication Data

US 2018/0344573 A1 Dec. 6, 2018

Related U.S. Application Data

(63) Continuation of application No. PCT/JP2017/001016, filed on Jan. 13, 2017.

(30) Foreign Application Priority Data

Feb. 24, 2016 (JP) ..... 2016-033151

(51) Int. Cl.
*B65H 5/22* (2006.01)
*A61J 3/06* (2006.01)
(Continued)

(52) U.S. Cl.
CPC ..... *A61J 3/06* (2013.01); *B41J 2/2135* (2013.01); *B41J 2/2146* (2013.01); *B41J 3/407* (2013.01);
(Continued)

(58) Field of Classification Search
CPC ..... A61J 3/06; B41J 2/2135; B65H 5/224; B65H 29/242; B65H 35/0006;
(Continued)

(56) References Cited

U.S. PATENT DOCUMENTS

2009/0145729 A1* 6/2009 Enomoto ..... B65H 5/224 198/807
2012/0328337 A1* 12/2012 Hiratsuka ..... G03G 15/1615 399/302
2014/0119782 A1* 5/2014 Fujii ..... G03G 15/0189 399/299

FOREIGN PATENT DOCUMENTS

JP 6-20920 1/1994
JP 6-115755 4/1994
(Continued)

OTHER PUBLICATIONS

International Search Report dated Mar. 21, 2017 in PCT/JP2017/001016, filed on Jan. 13, 2017 (with English Translation).

*Primary Examiner* — Thomas A Morrison
(74) *Attorney, Agent, or Firm* — Oblon, McClelland, Maier & Neustadt, L.L.P.

(57) ABSTRACT

According to one embodiment, a tablet printing apparatus includes: a conveyor belt configured to convey a tablet; a print head configured to perform printing on the tablet conveyed by the conveyor belt; and a belt-position detector configured to detect the position of the conveyor belt in a direction crossing the conveying direction of the tablet in a horizontal plane. The conveyor belt includes a plurality of holes arranged in a row along the conveying direction of the tablet to hold the tablet. The belt-position detector includes an imaging device configured to capture an image of two or more of the holes; and an image processing device configured to detect the position of the conveyor belt in the crossing direction based on the image captured by the imaging device.

14 Claims, 5 Drawing Sheets

(51) Int. Cl.

| | |
|---|---|
| ***B41J 3/407*** | (2006.01) |
| ***B65H 7/14*** | (2006.01) |
| ***B65H 7/20*** | (2006.01) |
| ***B41J 2/21*** | (2006.01) |
| ***B41J 11/00*** | (2006.01) |
| ***B41J 21/00*** | (2006.01) |
| ***B41J 29/387*** | (2006.01) |
| *A61J 3/00* | (2006.01) |

(52) U.S. Cl.
CPC ..... *B41J 11/007* (2013.01); *B41J 21/00* (2013.01); *B41J 29/387* (2013.01); *B65H 5/224* (2013.01); *B65H 7/14* (2013.01); *B65H 7/20* (2013.01); *A61J 3/007* (2013.01); *B65H 2511/20* (2013.01); *B65H 2511/512* (2013.01); *B65H 2513/41* (2013.01); *B65H 2515/60* (2013.01); *B65H 2553/42* (2013.01)

(58) Field of Classification Search
CPC .... B65H 29/686; B65H 29/56; B65H 29/243; B65H 2511/20; B65H 5/004; B65H 5/021; B65H 7/20; B65H 7/08; B65H 9/002; B65H 2404/2693; B65H 2511/512; B65H 2553/82; B65H 2553/83; B65H 2801/15
See application file for complete search history.

(56) References Cited

FOREIGN PATENT DOCUMENTS

| | | |
|---|---|---|
| JP | 6-239052 | 8/1994 |
| JP | 7-81050 | 3/1995 |
| JP | 2000-221860 | 8/2000 |
| JP | 2009-149398 | 7/2009 |
| JP | 2012-91375 | 5/2012 |
| KR | 10-2015-0037841 A | 4/2015 |

* cited by examiner

TABLET PRINTING APPARATUS AND TABLET PRINTING METHOD

CROSS-REFERENCE TO THE RELATED APPLICATION

This application is based upon and claims the benefit of priority from International Application No. PCT/JP2017/001016, filed on Jan. 13, 2017 and Japanese Patent Application No. 2016-033151, filed on Feb. 24, 2016; the entire contents of all of which are incorporated herein by reference.

FIELD

Embodiments described herein relate generally to a tablet printing apparatus and a tablet printing method.

BACKGROUND

Recently, there has been known a tablet printing apparatus that uses an inkjet print head for printing identification information such as characters, letters, marks or the like on tablets. In the tablet printing apparatus, tablets are conveyed by a conveyor belt. Ink is ejected from a nozzle of the inkjet print head located above the conveyor belt toward each tablet passing under the print head to print identification information on the tablet. The conveyor belt is wrapped around, for example, a drive pulley and a driven pulley, and is driven by the rotation of the drive pulley and the driven pulley.

Generally, on the occasion of maintenance such as cleaning and replacement of the conveyor belt, the conveyor belt is once removed from the apparatus and attached back to the apparatus after completion of the maintenance. At this time, in order to prevent degradation of the print quality on tablets, the conveyor belt needs to be attached to a predetermined position. However, it is difficult to attach the removed conveyor belt to the same position with high accuracy (for example, with an accuracy of 1 mm or less), and the conveyor belt may be displaced so as to be inclined with respect to the (regular) conveying direction of tablets in a horizontal plane. When such a displacement of the conveyor belt occurs, the tablet passing under the print head deviates from its desired position. As a result, the print quality tends to degrade.

DETAILED DESCRIPTION

According to one embodiment, a tablet printing apparatus includes: a conveyor belt configured to convey a tablet; a print head configured to perform printing on the tablet conveyed by the conveyor belt; and a belt-position detector configured to detect the position of the conveyor belt in a direction crossing the conveying direction of the tablet in a horizontal plane. The conveyor belt includes a plurality of holes arranged in a row along the conveying direction of the tablet to hold the tablet. The belt-position detector includes an imaging device configured to capture an image of two or more of the holes; and an image processing device configured to detect the position of the conveyor belt in the crossing direction based on the image captured by the imaging device.

According to another embodiment, there is provided a tablet printing method in which a tablet is conveyed by a conveyor belt and printing is performed on the tablet by a print head. The conveyor belt includes a plurality of holes arranged in a row along the conveying direction of the tablet to hold the tablet. The tablet printing method includes capturing an image of two or more of the holes by an imaging device; and detecting the position of the conveyor belt in a direction crossing the conveying direction of the tablet in a horizontal plane based on the image captured by the imaging device by an image processing device.

First Embodiment

A first embodiment will be described with reference to FIGS. 1 to 6.

(Basic Configuration)

Figure 1:
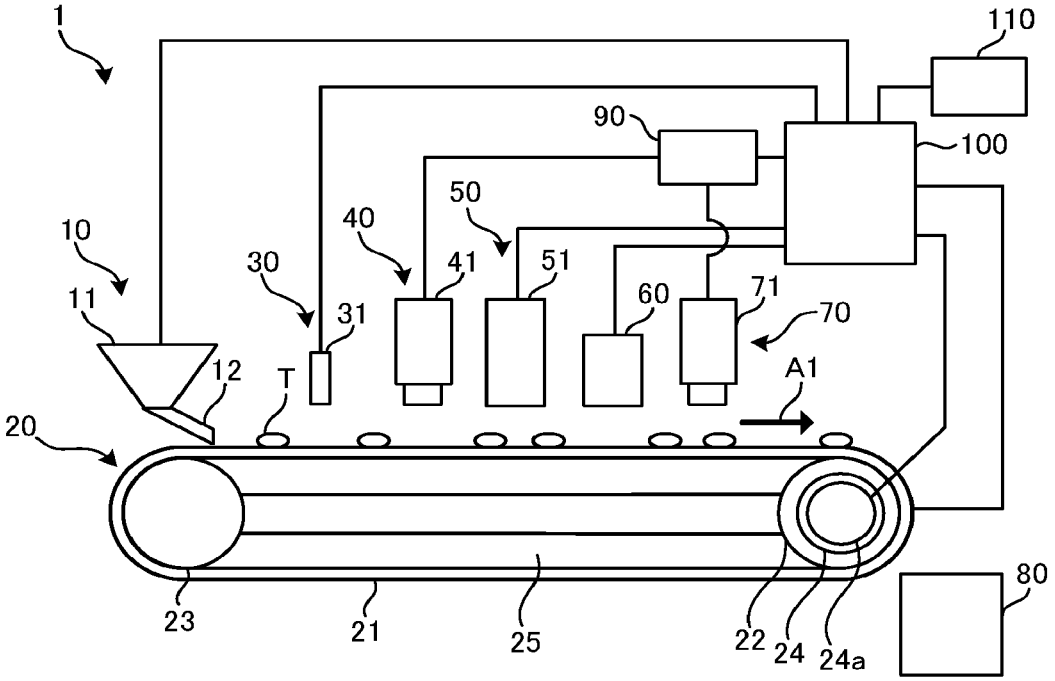
FIG. 1 is a diagram illustrating the schematic configuration of a tablet printing apparatus according to a first embodiment.
Figure 2:
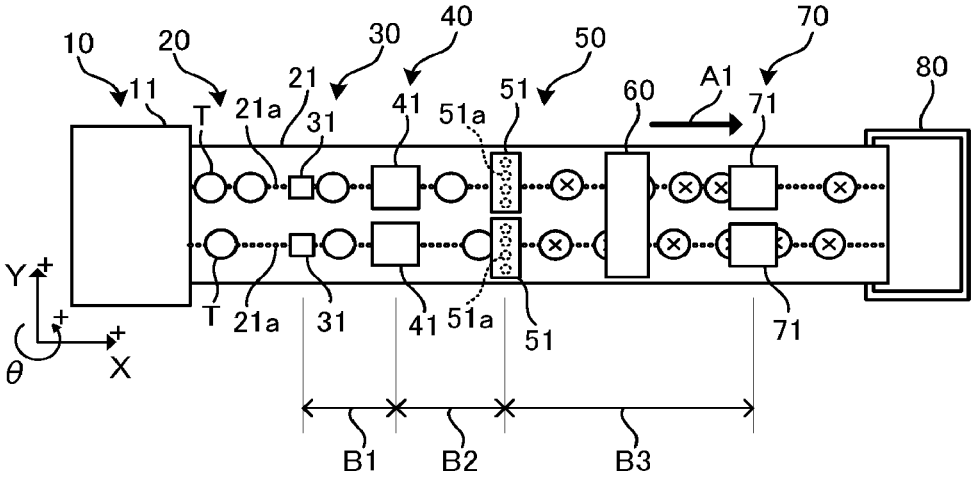
FIG. 2 is a plan view illustrating a part of the tablet printing apparatus of the first embodiment.

As illustrated in FIGS. 1 and 2, a tablet printing apparatus 1 of the first embodiment includes a supply device (supplier) 10, a conveying device (conveyor) 20, a detecting device (detector) 30, an imaging device (imager) 40, a printing device (printer) 50, a drying device (drier) 60, a checking device (checker) 70, a collecting device (collector) 80, an image processing device (image processer) 90, a control device (controller) 100, and a display device (display) 110.

The supply device 10 includes a hopper 11 and a chute 12. The hopper 11 stores a number of tablets T and sequentially supplies the tablets T to the chute 12. The chute 12 aligns the tablets T in a plurality of rows (two rows in the example of FIG. 2) and supplies them to the conveying device 20. The supply device 10 is electrically connected to the control device 100, and is driven under the control of the control device 100.

The conveying device 20 includes a conveyor belt 21, a drive pulley 22, a driven pulley 23, a drive unit (driver) 24, and a suction part (suction equipment) 25. The conveyor belt 21 is formed to be endless and wrapped around the drive pulley 22 and the driven pulley 23. The drive pulley 22 and the driven pulley 23 are arranged to be rotatable about a shaft, and the drive pulley 22 is connected to the drive unit 24. The drive unit 24 is, for example, a motor or the like. The drive unit 24 is electrically connected to the control device 100, and is driven under the control of the control device 100. The drive unit 24 includes a position detector **24*a* such as a rotary encoder. The position detector 24*a* sends a detection signal to the control device 100. The control device 100 can obtain information such as the position, speed, and movement amount of the conveyor belt 21 based on the detection signal. In the conveying device 20, the conveyor belt 21 rotates together with the driven pulley 23 as the drive pulley 22 is rotated by the drive unit 24 to convey the tablets T on the conveyor belt 21 in the direction of arrow A1 in FIGS. 1 and 2 (conveying direction A1**).

As illustrated in FIG. 2, a plurality of circular suction holes 21*a* are formed in the conveyor belt 21. These suction holes 21*a* are through holes for sucking the tablets T, and arranged in two rows in parallel along the conveying direction A1 so as to form two conveying paths. Each of the suction holes 21*a* is communicated with the suction part 25, and can obtain a suction force therefrom. The suction part 25 is configured to suck the tablets T on the conveyor belt 21 through the suction holes 21*a* to hold them. The suction holes 21*a* function as holes.

The detecting device 30 includes a plurality of detection units (detectors) 31 (two in the example of FIG. 2). The detection units 31 are located on the downstream side of the supply device 10 in the conveying direction A1, and are arranged in a direction crossing the conveying direction A1 (for example, a direction perpendicular to the conveying direction) in the horizontal plane. The detection units 31 are arranged above the conveyor belt 21, one for each conveying path of the tablets T. Each of the detection units 31 detects the tablets T on the conveyor belt 21 by projecting and receiving laser beams. For example, various laser sensors such as reflection laser sensors can be used as the detection units 31. Besides, various shapes of laser beams such as spot beams and line beams can be used. The detection units 31 are electrically connected to the control device 100 and send detection signals to the control device 100.

The imaging device 40 includes a plurality of imaging units (imagers) 41 (two in the example of FIG. 2). The imaging units 41 are located on the downstream side of the detecting device 30 in the conveying direction A1, and are arranged in a direction crossing the conveying direction A1 (for example, a direction perpendicular to the conveying direction) in the horizontal plane. The imaging units 41 are arranged above the conveyor belt 21, one for each conveying path of the tablets T. The imaging field of view of the imaging units 41 is set to such a size that at least one tablet T conveyed by the conveyor belt 21 can be situated therein. Each of the imaging units 41 performs imaging at the timing when each of the tablets T arrives immediately below it to capture an image including the upper surface of the tablet T (image for printing), and sends the image to the image processing device 90. Each of the imaging units 41 also performs imaging of the conveyor belt 21 at the timing when no tablet T is present immediately below it, for example, when the supply of the tablets T is stopped, to capture an image including the suction holes 21*a* of the conveyor belt 21 (image for detecting the position of the belt), and sends the image to the image processing device 90. Various cameras having an imaging device such as, for example, a charge-coupled device (CCD) or a complementary metal-oxide semiconductor (CMOS) can be used as the imaging units 41. Each of the imaging units 41 is electrically connected to the control device 100 via the image processing device 90, and is driven under the control of the control device 100. There may also be provided an illumination for imaging as necessary.

The printing device 50 includes a plurality of inkjet print heads 51 (two in the example of FIG. 2). The print heads 51 are located on the downstream side of the imaging device 40 in the conveying direction A1, and are arranged in a direction crossing the conveying direction A1 (for example, a direction perpendicular to the conveying direction) in the horizontal plane. The print heads 51 are arranged above the conveyor belt 21, one for each conveying path of the tablets T. The print heads 51 each include a plurality of nozzles 51*a* (see FIG. 2), and ejects ink (an example of a liquid) individually from each of the nozzles 51*a*. The print heads 51 are provided such that the direction in which the nozzles 51*a* are aligned crosses the conveying direction A1 (for example, perpendicularly to the conveying direction A1) in the horizontal plane. Various inkjet print heads having a drive element such as, for example, a piezoelectric element, a heat generating element, a magnetostrictive element or the like can be used as the print heads 51. Each of the print heads 51 is electrically connected to the control device 100, and is driven under the control of the control device 100.

The drying device 60 is shared between the two conveying paths. The drying device 60 is located on the downstream side of the printing device 50 in the conveying direction A1, and is arranged above the conveyor belt 21. The drying device 60 is configured to dry the ink applied to each of the tablets T on the conveyor belt 21. As the drying device 60, various types of dryers such as, for example, a heater for drying an object to be dried by radiation heat, a blower for drying an object to be dried with warm air or hot air, and the like can be used. The drying device 60 is electrically connected to the control device 100, and is driven under the control of the control device 100.

As with the imaging device 40, the checking device 70 includes a plurality of imaging units (imagers) 71 (two in the example of FIG. 2). The imaging units 71 are located on the downstream side of the drying device 60 in the conveying direction A1, and are arranged in a direction crossing the conveying direction A1 (for example, a direction perpendicular to the conveying direction) in the horizontal plane. The imaging units 71 are arranged above the conveyor belt 21, one for each conveying path of the tablets T. The imaging field of view of the imaging units 71 is set to such a size that at least one tablet T conveyed by the conveyor belt 21 can be situated therein. Each of the imaging units 71 performs imaging at the timing when each of the tablets T arrives immediately below it to capture an image including the upper surface of the tablet T (image for checking printing), and sends the image to the image processing device 90. Various cameras having an imaging device such as, for example, CCD or CMOS can be used as the imaging units 71. Each of the imaging units 71 is electrically connected to the control device 100 via the image processing device 90, and is driven under the control of the control device 100. There may also be provided an illumination for imaging as necessary.

The collecting device 80 is located on the downstream side of the checking device 70 in the conveying direction A1, and is arranged at the end of the conveying device 20 on the downstream side in the conveying direction A1. The collecting device 80 is configured to be able to sequentially receive and collect the tablets T released from holding by the conveying device 20 and dropped therefrom. The conveying device 20 releases the holding of each of the tablets T on the conveyor belt 21 when the tablet T reaches a desired position, for example, the end of the conveying device 20 on the downstream side in the conveying direction A1.

As illustrated in FIG. 2, for example, the distance B1 between the detecting device 30 and the imaging device 40 is about 80 mm. The distance B2 between the imaging device 40 and the printing device is about 70 mm. The distance B3 between the printing device 50 and the checking device 70 is about 170 mm. These numerical values are mentioned by way of example only, and the arrangement of each device can be changed as necessary.

Figure 3:
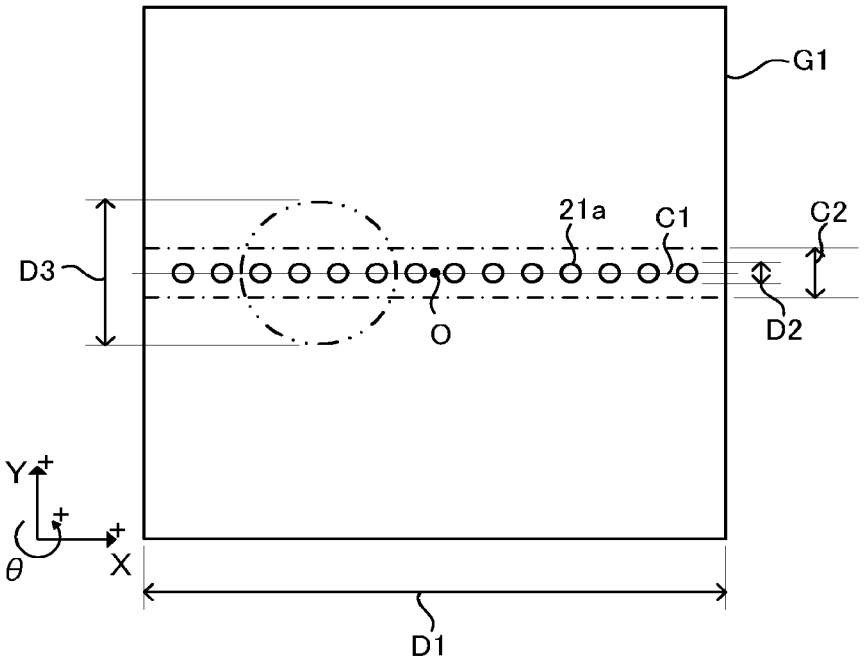
FIG. 3 is a diagram illustrating a photographed image when there is no displacement of a conveyor belt of the first embodiment.
Figure 4:
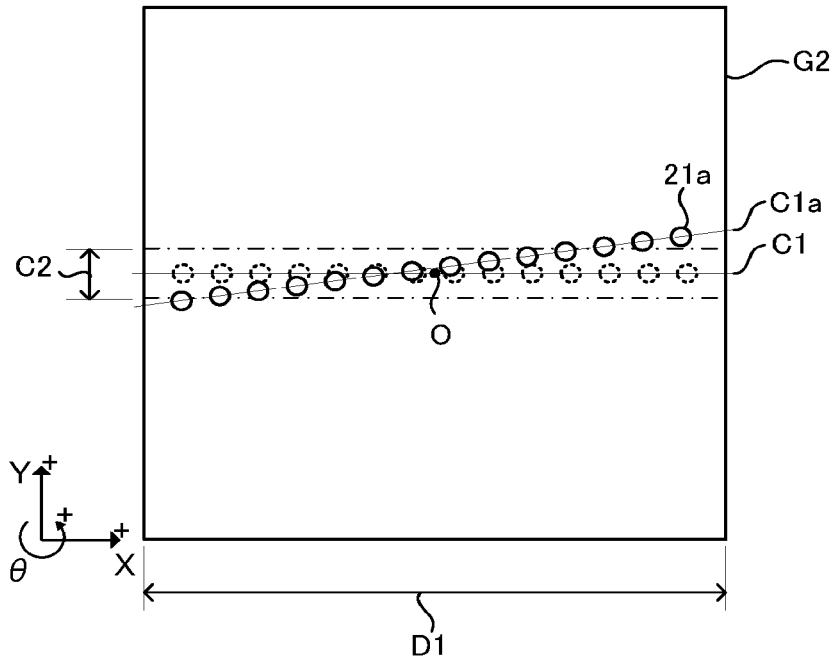
FIG. 4 is a diagram illustrating a photographed image when there is a displacement of the conveyor belt of the first embodiment.

The image processing device 90 takes in the image for printing or the image for checking printing captured by the imaging device 40 or the checking device 70. The image processing device 90 processes the image using a known image processing technique. The image processing device 90 takes in the image of the tablet T for printing before the printing is performed, and detects the position of the tablet T in the X direction (the conveying direction A1), Y direction, and e direction. As illustrated in FIGS. 3 and 4, the position in the X and Y directions corresponds to, for example, a position in the XY coordinate system with respect to the center O of the imaging field of view, and indicates how much the tablet T deviates from the center O of the imaging field of view. Besides, the position in the e direction is a position that indicates, for example, the degree of rotation of the tablet T with respect to the center line C1 of the imaging field of view of the imaging unit 41 in the Y direction, i.e., how much the tablet T has rotated with respect to the center line C1 in the horizontal plane. The position in the θ direction is detected when the tablet T has a directional property such as when the tablet T has a split line or when the tablet T is formed in an elliptical shape, an oval shape, a quadrangular shape, or the like. The image processing device 90 takes in the image for checking printing on the tablet T after printing by the print head 51 from the checking device 70, and detects the position of a print pattern (for example, a character, a letter, a mark, etc.) printed on the tablet T. The image processing device 90 and the imaging device 40 function as a tablet position detecting device (detector) that detects the position of the tablet T.

Further, the image processing device 90 takes in the image for detecting the position of the belt captured by the imaging device 40. The image processing device 90 processes the image using a known image processing technique, and detects the position of each of the suction holes 21*a* in the Y direction. The image processing device 90 is also capable of detecting the position of each of the suction holes 21*a* in the X direction if necessary. As illustrated in FIGS. 3 and 4, the position in the X and Y directions corresponds to, for example, a position in the XY coordinate system with respect to the center O of the imaging field of view of the imaging unit 41, and indicates how much the suction hole 21*a* deviates from the center O of the imaging field of view. The image processing device 90 and the imaging device 40 also function as a belt position detection device (detector) that detects the position of the conveyor belt 21 in the Y direction.

As illustrated in FIG. 3, an image G1 is captured by the imaging unit 41 when the position of each of the suction holes 21*a* in the Y direction is at a regular position, that is, when there is no positional deviation of the conveyor belt 21 in the Y direction. The regular position is a position where a straight line passing through the center of each of the suction holes 21*a* overlaps with the center O of the imaging field of view of the image G1 and also corresponds to the center line C1 of the imaging field of view in the Y direction. By detecting the distance of each of the suction holes 21*a* from the regular position, the positional deviation state (amount and direction) of the conveyor belt 21 in the Y direction is detected. For example, as described later, a range within about ±0.1 mm from the center line C1 is set as an allowable range C2 (set within the field of view of the imaging unit 41), and is stored in the control device 100 in advance. The control device 100 compares the position of each of the suction holes 21*a* in the Y direction obtained from the image captured by the imaging device 40 with the allowable range C2. If the suction holes 21*a* are located in the allowable range C2, the control device 100 determines that there is no need to adjust the position of the conveyor belt 21. For example, the length D1 of a square imaging field of view in the X direction is 30 mm, and the diameter D2 of the suction hole 21*a* is 2 mm. Although the diameter D3 of the tablet T varies depending on its type, it is about 5 mm to 10 mm.

On the other hand, as illustrated in FIG. 4, an image G2 is captured when the position of each of the suction holes 21*a* in the Y direction does not fall within the allowable range C2. The suction holes 21*a* are located in different positions in the Y direction (the straight line passing through the center of each of the suction holes 21*a* at this time is denoted by C1*a*). According to the image G2, the position of each of the suction holes 21*a* in the Y direction is out of the allowable range C2, which means that the conveyor belt 21 is deviated from the reference position. Thus, printing cannot be performed precisely on the tablets T. If at least two suction holes 21*a*, for example, an adjacent pair of the suction holes 21*a*, are located in different positions (numerical values) in the Y direction, it can be determined that the straight line C1*a* passing through the center of each of the suction holes 21*a* is tilted with respect to the center line C1. For example, when one of the suction holes 21*a* is located at a position +0.3 mm from the center line C1 in the Y direction and the one adjacent thereto is located at a position +0.4 mm from the center line C1 in the Y direction, it can be seen that the straight line C1*a* is tilted more than the allowable range with respect to its regular position, the center line C1.

Figure 5:
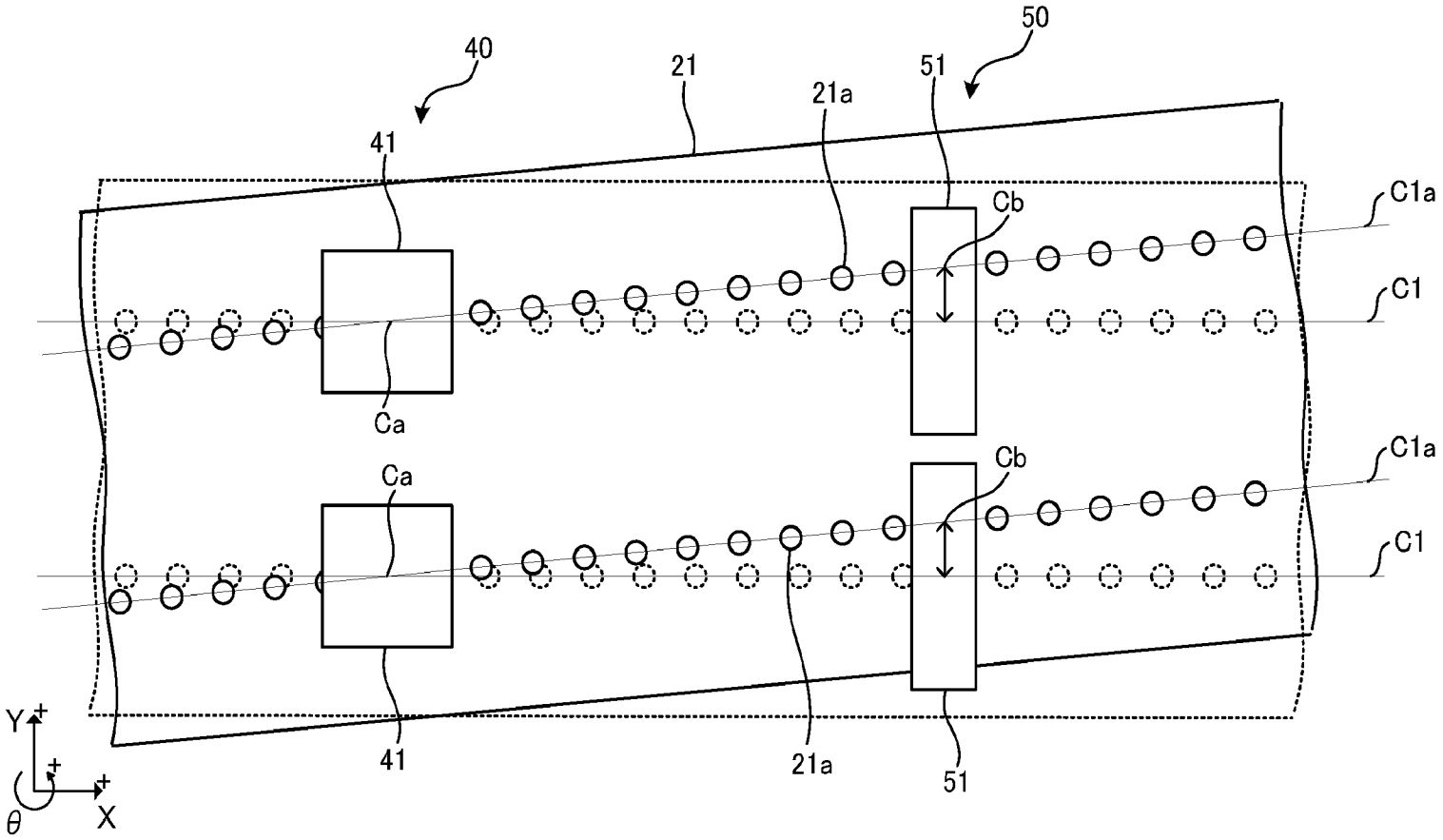
FIG. 5 is a diagram for explaining the displacement of the conveyor belt of the first embodiment.

When the image G2 illustrated in FIG. 4 is captured, as illustrated in FIG. 5, the suction holes 21*a* are shifted in such a manner that the straight line C1*a* passing through the center of them is rotated in the +e direction with respect to the center line C1. Assuming that the side above the center line C1 is regarded as plus (+) and the side below it is minus (−), the suction holes 21*a* on the left side of the intersection of the center line C1 and the straight line C1*a* are shifted to the minus side with respect to the center line C1, while the suction holes 21*a* on the right side are shifted to the plus side with respect to the center line C1. The position of each of the suction holes 21*a* in the Y direction is detected by the image processing described above.

In the example of FIG. 5, the tablets T being conveyed obliquely move with respect to the center line C1 from the imaging position Ca of the imaging unit 41 to the printing position Cb of the print head 51. Normally, various printing conditions are set on the assumption that the imaging position Ca and the printing position Cb are located on the center line C1 as a reference position, that is, the imaging position Ca and the printing position Cb are not deviated in the Y direction. Therefore, when the tablets T being conveyed obliquely move with respect to the center line C1 from the imaging position Ca to the printing position Cb, the imaging position Ca and the printing position Cb are deviated in the Y direction. As a result, printing cannot be performed precisely on the tablets T. Therefore, when the imaging position Ca and the printing position Cb have deviated more than the allowable range in the Y direction, it is necessary to avoid performing printing.

In addition to the example of FIG. 5, the straight line C1*a* passing through the center of each of the suction holes 21*a* may shift in parallel to the center line C1 to either one of the plus/minus (±) sides in the Y direction. In this case, if the tablet T being conveyed enters the imaging field of view of the imaging unit 41, it moves in parallel to the center line C1 from the imaging position Ca to the printing position Cb. Accordingly, the imaging position Ca and the printing position Cb are not deviated in the Y direction, and printing can be performed precisely on the tablet T by adjusting the printing conditions. However, since each of the suction holes 21*a* has shifted in the Y direction with respect to the center line C1, the tablets T being conveyed are highly likely to be out of the imaging field of view. Therefore, it is desirable that the position of each of the suction holes 21*a* in the Y direction be within the allowable range C2.

The image processing device 90 feeds to the control device 100 with information on the position of each of the tablets T in the X direction, Y direction, and θ direction detected, information on the print position of a print pattern on the tablet T, and also information on the position of each of the suction holes 21*a* in the Y direction. The image processing device 90 adds identification information of each of the imaging units 41 or 71 to the position information when sending the information to the control device 100. Thereby, the control device 100 can identify which of the imaging units 41 and 71 the pieces of position information belong to.

The control device 100 includes a microcomputer that intensively controls each unit and a storage that stores processing information, various programs, and the like (not illustrated). The control device 100 controls the supply device 10, the conveying device 20, the imaging device 40, the printing device 50, the drying device 60, the checking device 70, and the image processing device 90 based on various information and various programs. In addition, the control device 100 receives detection signals and the like sent from the detecting device 30 and the position detector 24*a*.

Besides, based on the information on the position of each of the tablets T in the X direction, Y direction, and e direction received from the image processing device 90, the control device 100 sets printing conditions for the tablet T the position of which has been detected in the X direction, direction, and e direction. The storage stores print data including print patterns such as characters, letters, and marks to be printed on the tablets T and print positions where print patterns are to be printed on the tablets T, information on the movement speed of the conveyor belt 21, and the like.

For example, based on the information on the position of each of the tablets T in the Y direction, the control device 100 determines the use range of the nozzles 51*a* of the print head 51 used for current printing. As an example, among the nozzles 51*a* of the print head 51, five of them are used for applying ink to the tablets T. When the positions of the tablets T have shifted by one pitch of the arrangement interval of the nozzles 51*a* in the Y direction, the control device 100 sets the use range of the nozzles 51*a* so as to use five nozzles 51*a* shifted by one pitch in the direction in which the tablets T have shifted as a printing condition.

The control device 100 also determines the timing to start printing on the tablets T based on the information on the position of each of the tablets T in the X direction. For example, when the tablets T have shifted by a distance ΔX to the upstream side in the conveying direction A1, the control device 100 sets the printing conditions so as to start printing at a timing delayed by the time required for the conveyor belt 21 to move by the distance ΔX as compared to the case where the tablets T have not shifted in the X direction.

The control device 100 sets the printing conditions correspondingly to the positions of the tablets T in the θ direction based on the information on the position of each of the tablets T in the e direction. For example, the storage of the control device 100 stores 180 types of print data obtained by rotating a print pattern such as a character, a letter or a mark one by one degree in the range of 0° to 179°. The control device 100 selects one of the print data corresponding to an angle that matches the position in the θ direction detected and set it as a print condition.

Further, based on the information on the print position of the print pattern on each of the tablets T received from the image processing device 90, the control device 100 determines whether the print pattern (for example, a character, a letter, a mark, etc.) has been properly printed on the tablet T. For this purpose, the control device 100 stores a correct print pattern in advance, and compares the correct print pattern with the actual print pattern on the tablet T after printing. Having determined that the print pattern is properly printed on the tablet T, the collecting device 80 collects the tablet T that has passed the inspection under the control of the control device 100. On the other hand, when the control device 100 determines that the print pattern is not properly printed on the tablet T, the tablet T that failed the inspection is collected by a collecting container (not illustrated) other than the collecting device 80.

In addition, based on the information on the position of each of the suction holes 21*a* in the Y direction received from the image processing device 90, the control device 100 determines whether the position of the suction hole 21*a* in the Y direction is within the allowable range C2. When the position of the suction hole 21*a* in the Y direction is out of the allowable range C2, the control device 100 finds a position abnormality of the conveyor belt 21. For example, having determined from the image G1 that the position of each of the suction holes 21*a* in the Y direction is within the allowable range C2, the control device 100 permits printing. On the other hand, having determined from the image G2 that the position of each of the suction holes 21*a* in the Y direction is out of the allowable range C2, the control device 100 prohibits printing as finding the position abnormality of the conveyor belt 21.

The display device 110 displays various images such as an image indicating the position abnormality of the conveyor belt 21. When the control device 100 finds the position abnormality of the conveyor belt 21, the display device 110 displays an image indicating the position abnormality of the conveyor belt 21. The view of the image enables the user to know the position abnormality of the conveyor belt 21. Having recognized the position abnormality, the user can correct the position of the conveyor belt 21. The display device 110 is electrically connected to the control device 100, and is driven under the control of the control device 100. As the display device 110, for example, a liquid crystal display (LCD) or the like can be used.

(Printing Step)

Next, a printing step (printing process) performed by the tablet printing apparatus 1 will be described with reference to FIG. 6 (and FIG. 1 as required). Until printing is performed, various types of information such as print data required for printing is stored in the storage of the control device 100. Besides, a large number of tablets T to be printed are stored in the hopper 11 of the supply device 10.

Figure 6:
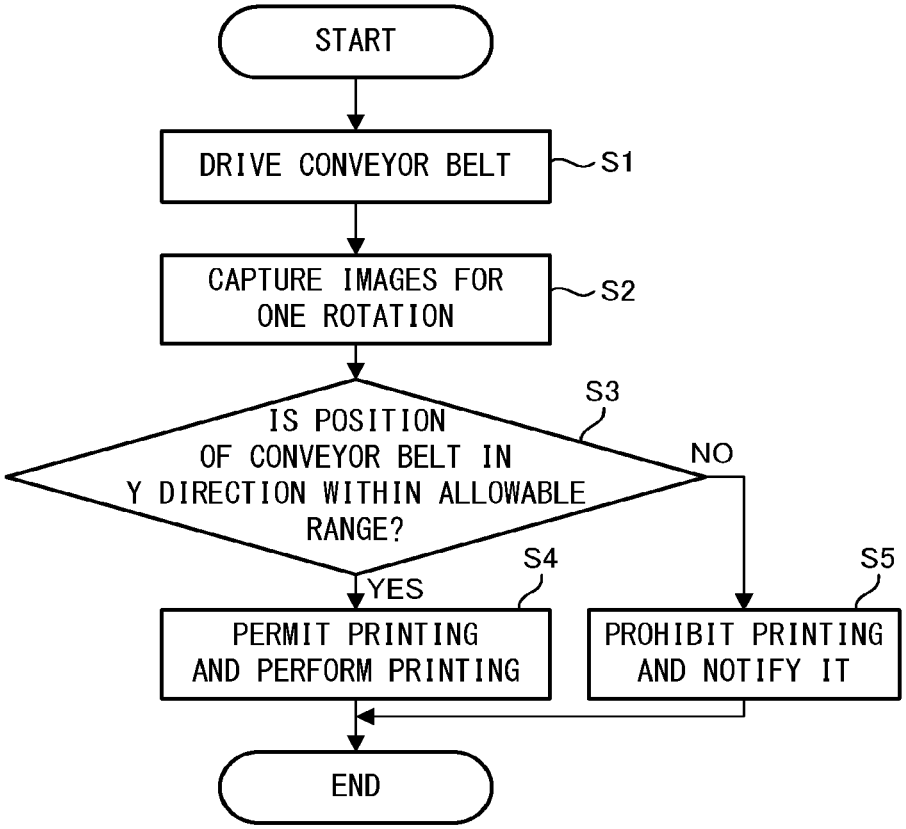
FIG. 6 is a flowchart illustrating a printing process performed by the tablet printing apparatus of the first embodiment.

As illustrated in FIG. 6, in step S1, the conveyor belt 21 of the conveying device 20 is driven when the supply device 10 is not supplying the tablets T to the conveying device 20. As the drive pulley 22 and the driven pulley 23 are rotated by the drive unit 24, the conveyor belt 21 rotates in the conveying direction A1. Next, in step S2, each of the imaging units 41 of the imaging device 40 continuously captures images while the conveyor belt 21 is moving, and thereby images for one rotation of the conveyor belt 21 are captured. In step S3, it is determined whether the position of each of the suction holes 21*a* in the Y direction is within the allowable range C2, that is, whether the position of the conveyor belt 21 in the Y direction is within the allowable range, based on the images captured in step S2. Since a plurality of images are captured for one rotation of the conveyor belt 21, it is possible to know whether the conveyor belt 21 is weaving, and also the weaving degree thereof.

As described above, when providing the control device 100 with the information on the position of each of the suction holes 21*a* in the Y direction, the image processing device 90 adds the identification information of each of the imaging units 41 to the position information before sending it. Thus, the control device 100 can determine whether the position of each of the suction holes 21*a* in the Y direction is within the allowable range at its position. Printing may be prohibited if, among a plurality of images captured by the imaging unit 41, a predetermined number or more of images contain a part out of the allowable range.

If it is determined in step S3 that the position of the conveyor belt 21 in the Y direction is within the allowable range (YES), printing is permitted in step S4, and the supply of the tablets T is started to perform printing. On the other hand, if it is determined in step S3 that the position of the conveyor belt 21 in the Y direction is out of the allowable range (NO), printing is prohibited in step S5, and the user is notified of the position abnormality of the conveyor belt 21. At this time, for example, an image indicating the position abnormality of the conveyor belt 21 is displayed on the display device 110. The view of the image enables the user to know the position abnormality of the conveyor belt 21, and the user can correct the position of the conveyor belt 21. In addition to the display device 110, an output device that outputs sound such as voice or alarm, or light such as blinking light or the like can be used for notifying the position abnormality of the conveyor belt 21. Further, the display device 110 may display an image that enables the user to know which part of the conveyor belt 21 is deviated in which direction.

(Printing Operation)

At the time of the printing in step S4, the conveyor belt 21 is driven. The conveyor belt 21 rotates in the conveyance direction A1 as the drive pulley 22 and the driven pulley 23 are rotated by the drive unit 24. While the conveyor belt 21 is rotating, the tablets T are sequentially supplied from the supply device 10 onto the conveyor belt 21 not at regular intervals but at random. The tablets T are conveyed at a predetermined moving speed in two rows on the conveyor belt 21.

Each of the detection units 31 detects each of the tablets T on the conveyor belt 21 in each of the conveying paths, and feeds the control device 100 with a detection signal as a trigger signal. Thereafter, each of the imaging units 41 captures images of the tablets T on the conveyor belt 21 in each of the conveying paths. Each of the imaging units 41 captures an image of the upper surface of each of the tablets T at the timing based on the trigger signal, that is, at the timing when the tablet T arrives below the imaging unit 41, and sends the image to the image processing device 90. The image processing device 90 generates information on the position of the tablet T (for example, information on the position of the tablet T in the X direction, the Y direction, and the direction) based on the image received from the imaging unit 41, and sends it to the control device 100. The control device 100 sets printing conditions for the tablets T based on the position information of the tablets T.

After that, the printing device 50 performs printing based on the printing conditions at the timing based on the trigger signal, that is, at the timing when each of the tablets T arrives below each of the print heads 51. In each of the print heads 51 of the printing device 50, each of the nozzles 51*a* ejects ink as appropriate, and identification information such as a character, a letter or a mark is printed on the upper surface of the tablet T. The drying device 60 dries the ink applied to the tablet T. Note that if the ink is of a type which dries quickly, the drying device 60 may be not necessary.

After the ink is dried, the checking device 70 checks the tablet T. Specifically, after the ink is dried, each of the imaging units 71 captures an image of the tablet T in each of the conveying paths of the tablets T, and sends the image to the image processing device 90. The image processing device 90 generates information on the print position of the print pattern based on the image received from the imaging unit 71, and sends it to the control device 100. The control device 100 determines whether the print on the tablet T is acceptable based on the information on the print position of the print pattern.

Thereafter, the tablet T, which has undergone the check, is released from the holding by the conveyor belt 21 when arriving at the downstream end portion of the conveyor belt 21. The tablet T drops from the conveyor belt 21, and is collected by the collecting device 80. At this time, if the tablet T has passed the check, it drops directly into the collecting device 80 to be collected. On the other hand, if the tablet T has failed the check, it is eliminated by air blowing while dropping from the conveyor belt 21. The tablet T eliminated by air blowing is collected by, for example, another collection container (not illustrated) arranged next to the collecting device 80.

In the printing process, when the position of the conveyor belt 21 is out of the allowable range, it is determined that the position of the conveyor belt 21 is abnormal, and printing is prohibited. Thereby, printing is prevented from being performed when the position of the conveyor belt 21 is abnormal. Thus, the print quality on the tablets can be suppressed from being degraded. Further, since the user is notified of the position abnormality of the conveyor belt 21, the user can correct the position of the conveyor belt 21 in the Y direction to a normal position by knowing the position abnormality of the conveyor belt 21.

As described above, according to the first embodiment, the image processing device 90 detects the position of the conveyor belt 21 in a direction perpendicular to the conveying direction A1 of the tablet T in the horizontal plane, i.e., the position in the Y direction, based on the image captured by the imaging device 40. With this, the control device 100 can determine whether the position of the conveyor belt 21 in the Y direction is abnormal or not. Having determined that the position of the conveyor belt 21 in the Y direction is abnormal, the control device 100 prohibits printing on the tablets T or stops the conveyor belt 21. In this manner, printing is prevented from being performed when the position of the conveyor belt 21 in the Y direction is abnormal. Thereby, it is possible to suppress the degradation of print quality. Further, since the position abnormality of the conveyor belt 21 can be found out, for example, when the printed tablets T conveyed by the conveyor belt 21 are transferred to another belt (not illustrated) instead of being collected by the collecting device 80, it is possible to prevent the shift of the transfer position or the dropping of the tablets T due to the shift of the transfer position.

Incidentally, the image processing device 90 may use an image for detecting the position of the belt captured by the checking device 70 instead of or in addition to the image for detecting the position of the belt captured by the imaging device 40. In this case, as with the imaging units 41 of the imaging device 40, the imaging units 71 of the checking device 70 each photograph the conveyor belt 21 when no tablet T is present immediately below them to capture an image that contains each of the suction holes 21*a* of the conveyor belt 21 (image for detecting the position of the belt), and sends the image to the image processing device 90. In this manner, the checking device 70 also functions as an imaging device (imager), and either or both of the imaging device 40 and the checking device 70 can be used to detect the position of each of the suction holes 21*a* in the Y direction. In the case of using both of them, for example, printing is performed when the position (positional deviation) of the conveyor belt 21 detected based on an image (image for detecting the position of the belt) captured by the imaging device and that detected based on an image (image for detecting the position of the belt) captured by the checking device 70 are both within the allowable range.

Second Embodiment

A second embodiment will be described with reference to FIG. 7. In the second embodiment, the difference (laser displacement meter for detecting the position of the conveyor belt) from the first embodiment will be described, and the same explanation will not be repeated.

Figure 7:
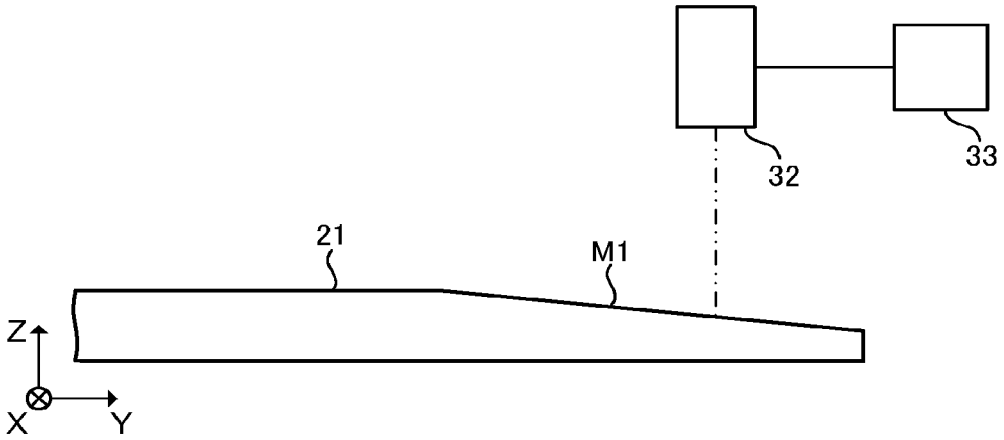
FIG. 7 is a diagram for explaining the detection of displacement of a conveyor belt according to a second embodiment.

As illustrated in FIG. 7, the tablet printing apparatus 1 of the second embodiment includes a laser displacement meter 32 and a belt position calculator in addition to the devices 10 to 100 described in the first embodiment. Instead of the imaging device 40 and the image processing device 90 according to the first embodiment, the laser displacement meter 32 and the belt position calculator 33 function as a belt-position detector that detects the position of the conveyor belt 21 in the Y direction. The conveyor belt is provided with an inclined surface M1, on which laser beams emitted from the laser displacement meter are incident, at one end in the Y direction (for example, the end on the plus side in the Y direction). The inclined surface M1 is gradually lowered from the inside to the outside of the conveyor belt 21 along the Y direction.

The laser displacement meter 32 measures the separation distance between itself and the inclined surface M1 of the conveyor belt 21 by projecting and receiving laser beams. The laser displacement meter 32 is electrically connected to the belt position calculator 33, and sends a detection signal to the belt position calculator 33. For example, various laser sensors such as a reflection laser sensor can be used as the laser displacement meter 32. Besides, various shapes of laser beams such as spot beams and line beams can be used.

The belt position calculator 33 figures out the position of the conveyor belt 21 in the Y direction based on the separation distance between the laser displacement meter 32 and the inclined surface M1 of the conveyor belt 21 measured by the laser displacement meter 32. As described above, the inclined surface M1 is formed such that its thickness decreases toward the plus side and increases toward the minus side along the Y direction. Therefore, the separation distance measured by the laser displacement meter 32 decreases when the conveyor belt 21 deviates to the plus side in the Y direction, and increases when it deviates to the minus side. That is, the separation distance varies according to the movement of the conveyor belt 21 in the Y direction. The belt position calculator 33 converts the separation distance into the position of the conveyor belt 21 in the Y direction based on the correlation between the separation distance and the amount by which the conveyor belt 21 has deviated in the Y direction.

The larger separation distance means that the conveyor belt 21 has deviated more to the minus side in the Y direction. On the other hand, the smaller separation distance means that the conveyor belt 21 has deviated more to the plus side in the Y direction. For example, the laser displacement meter 32 is fixedly arranged at any two points on the circumference of the conveyor belt 21 to measure the separation distance between the laser displacement meter 32 and the inclined surface M1 of the conveyor belt 21 at the two points, i.e., predetermined positions aligned in the conveyance direction A1. The inclination (rotation in the θ direction) of the conveyor belt 21 in the horizontal plane and the position of each of the suction holes 21*a* can be determined based on the measurement values obtained by the laser displacement meters 32 arranged at least two points and the distance between the two points. From the inclination and the position, it is possible to determine whether the position of each of the suction holes 21*a* in the Y direction falls within the allowable range. The belt position calculator 33 converts the separation distance into the position of the conveyor belt 21 in the Y direction based on the correlation between the separation distance and the amount by which the conveyor belt 21 has deviated in the Y direction. It is also possible to continuously measure the separation distance while the conveyor belt 21 is moving. Alternatively, the conveyor belt 21 may be intermittently moved to measure the separation distance. In this case, it is possible to know whether the conveyor belt 21 is weaving, and also the weaving degree thereof.

As described above, according to the second embodiment, it is possible to achieve the same effects as those of the first embodiment. For example, the inclined surface M1 is formed on the surface of the conveyor belt 21 so as to gradually incline along the Y direction. The plurality of laser displacement meters 32 that emit laser beams to the inclined surface M1 is provided. The position of the conveyor belt 21 in the Y direction is obtained from the separation distance between the inclined surface M1 and the laser displacement meters 32. This makes it possible to detect the position of the conveyor belt 21 in the Y direction without using the imaging device 40, the image processing device 90, and the like. Thus, as in the first embodiment, it is possible to suppress the degradation of print quality.

On the contrary to the above, the inclined surface M1 located at the end of the conveyor belt 21 may be formed so as to gradually become higher from the inside to the outside of the conveyor belt 21 along the Y direction. In other words, the structure of the inclined surface M1 is not particularly limited as long as the separation distance between the laser displacement meter 32 and the inclined surface M1 varies according to the movement of the conveyor belt 21 in the Y direction.

Third Embodiment

A third embodiment will be described with reference to FIG. 8. In the third embodiment, the difference (image display of the display device) from the first embodiment will be described, and the same explanation will not be repeated.

Figure 8:
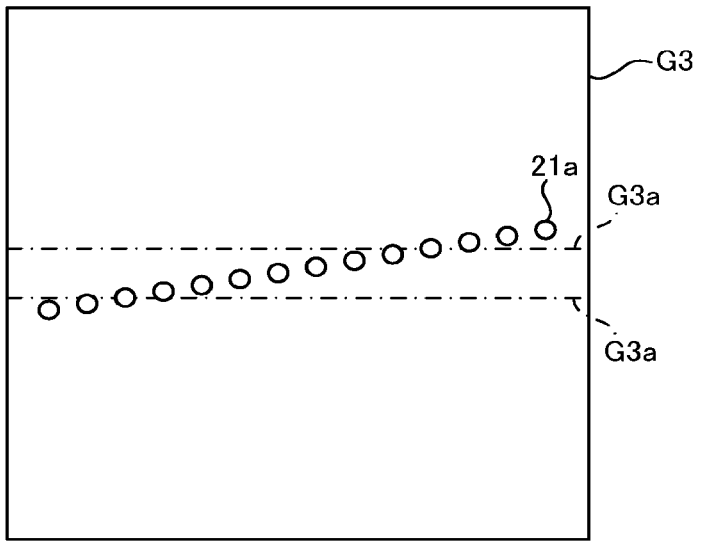
FIG. 8 is a diagram illustrating a display image when there is a displacement of a conveyor belt according to a third embodiment.

The display device 110 of the third embodiment displays images such as an image G3 captured by the imaging device 40 as illustrated in FIG. 8. The display device 110 receives the image captured by the imaging device 40 through the image processing device and the control device 100 and displays the image under the control of the control device 100. The display device can also display images captured by the checking device 70 in the same manner.

For example, the display device 110 displays the image G3 captured by the imaging device 40 in real time as illustrated in FIG. 8. The image G3 illustrates two dashed-dotted lines G3*a* as lines indicating the allowable range C2. By viewing the image G3 displayed on the display device 110, the user can determine whether the position of each of the suction holes 21*a* in the Y direction is within the allowable range C2. Having determined that the position of each of the suction holes 21*a* in the Y direction is out of the allowable range C2, the user recognizes the position abnormality of the conveyor belt 21, and corrects the position of the conveyor belt 21 in the Y direction. At this time, while viewing the image displayed in real time, the user corrects the position of the conveyor belt 21 in the Y direction so that the positions of the suction holes 21*a* in the Y direction are each located within the allowable range C2. Thus, the user can easily perform the correction.

As described above, according to the third embodiment, it is possible to achieve the same effects as those of the first embodiment. For example, the imaging device 40 captures an image (for example, the image G3) illustrating the position of the conveyor belt 21 in a direction perpendicular to the conveying direction A1 of the tablet T in the horizontal plane, i.e., the position in the Y direction, and the display device 110 displays the image. Thereby, the user can determine whether the position of the conveyor belt 21 in the Y direction is abnormal or not by visually checking the image displayed. Having determined that the position of the conveyor belt 21 in the Y direction is abnormal, the user can prohibit printing on the tablets T or stop the conveyor belt 21. In this manner, printing is prevented from being performed when the position of the conveyor belt 21 is abnormal. Thereby, it is possible to suppress the degradation of print quality.

Other Embodiments

In the above embodiments, the tablets T are conveyed in two rows; however, it is not so limited. There may be one row, three rows, or four or more rows. The number of rows is not particularly limited.

In the above embodiments, there is provided only one conveyor belt 21; however, it is not so limited. The number of conveyor belts is not particularly limited, and there may be two or more conveyor belts.

In the above embodiments, the print head 51 is described as being provided in each of the conveying paths of the tablets T; however, it is not so limited. For example, one print head 51 may perform printing on two or more rows of tablets T.

In the above embodiments, an example is described in which the timing of printing is determined based on the detecting device 30; however, it is not so limited. For example, the timing of printing may be determined based on the imaging device 40.

In the above embodiments, a print head in which the nozzles 51*a* are arranged in a row is described as an example of the inkjet print head 51; however, it is not so limited. For example, a print head in which the nozzles 51*a* are arranged in a plurality of rows may be used. Further, a plurality of print heads may be arranged along the conveying direction A1 of the tablets T.

In the above embodiments, the suction part 25 is formed over the entire circumference of the conveyor belt 21; however, it is not so limited. The suction part 25 need not necessarily extend over the entire circumference of the conveyor belt 21. The suction part 25 may be formed only in a portion from where the tablet T is supplied to where it is collected as described above.

In the above embodiments, an example is described in which printing is performed on one side of the tablet T; however, it is not so limited. For example, the conveying devices 20 or the like may be arranged one above the other. In this case, the tablet T printed by the upper conveying device 20 is turned upside down and delivered to the lower conveying device 20 to print the other side.

In the above embodiments, an example is described in which the position of the conveyor belt in a direction perpendicular to the conveying direction A1 of the tablet T in the horizontal plane, i.e., the position of the conveyor belt 21 in the Y direction, is detected; however, it is not so limited. The position abnormality of the conveyor belt 21 can be determined by detecting at least the position of the conveyor belt 21 in a direction crossing the conveying direction A1 of the tablet T in the horizontal plane.

In the above embodiments, the circular suction holes 21*a* are described as an example of holes for holding the tablets T; however, it is not so limited. For example, the suction holes 21*a* may have such a shape as rectangle, ellipse, slit, and the like. The shape of the suction holes 21*a* is not particularly limited. Besides, the suction holes 21*a* are described by way of example as being through holes; however, it is not so limited. For example, the suction part 25 may be eliminated, and, instead of the suction holes 21*a*, concave holes may be formed on the surface of the conveyor belt 21 to keep the tablets T.

In the above embodiments, the suction hole 21*a* is used as a detection mark for detecting the position of the conveyor belt 21; however, it is not so limited. For example, another mark formed on the surface of the conveyor belt 21 may be used. As this mark, besides the suction hole 21*a*, the aforementioned concave hole, a mark such as a straight line, a cross line, and the like can be used. In addition, one of the ends of the conveyor belt 21 in the Y direction can also be used as the detection mark.

Nevertheless, when the suction hole 21*a* is used as the detection mark as described above, there is no need to print the detection mark on the conveyor belt 21. For example, when the detection mark is printed so that a color of the detection mark is clearly distinguishable from the conveyor belt 21, it can be clearly recognized in images captured by the imaging units 41 and 71, which is advantageous. This, however, requires consideration in order to prevent printed marks from being peeled off due to deterioration and no longer used, or the peeled-off ink from adhering to the tablets T to be printed. Since the tablets T are often to be taken into the human body, proper hygienic management is essential. It is desirable not to use inks other than those used for printing on the tablets T as much as possible.

In the above embodiments, an example is described in which the position of the conveyor belt 21 is detected by using the detection mark provided on the conveyor belt 21; however, it is not so limited. The tablet T conveyed on the conveyor belt 21 may be used as the detection mark.

In the above embodiments, an example is described in which images (a plurality of images) are captured for one rotation of the conveyor belt 21 while the conveyor belt 21 is moving and used for detecting the position abnormality of the conveyor belt 21; however, it is not so limited. For example, images of the conveyor belt 21 may be captured while the conveyor belt 21 is stopped (including when the conveyor belt 21 is stopped during intermittent movement) and used for detecting the position abnormality of the conveyor belt 21. Further, although the position abnormality of the conveyor belt 21 is described as being detected based on images captured by the imaging unit 41 of the imaging device 40; however, it is not so limited. For example, the position abnormality of the conveyor belt 21 may be detected based on images captured by the imaging unit of the imaging device 40 as well as those captured by the imaging unit 71 of the checking device 70 in same conveying path. The position abnormality of the conveyor belt 21 can be detected with higher accuracy by using a larger number of images in this manner. For example, the control device 100 may calculate the position of the conveyor belt 21 in the Y direction and the inclination thereof based on the position of at least one suction hole 21*a* in the Y direction obtained from an image captured by the imaging unit 41, the position of at least one suction hole 21*a* in the Y direction obtained from an image captured by the imaging unit 71, and the distance between the imaging unit 41 and the imaging unit 71, and determine whether the position of the conveyor belt 21 is within the allowable range based on the values calculated.

In the above embodiments, an example is described in which printing is determined to be permitted or prohibited based on information on the position of each of the suction holes 21*a* in the Y direction; however, it is not so limited. For example, printing may be performed by changing the print pattern based on the information on the position of each of the suction holes 21*a* in the X direction and Y direction instead of prohibiting the printing. More specifically, the control device 100 may correct the position information of the tablet T (for example, information on the position of the tablet T in the X direction, the Y direction, and the θ direction) based on the position information of each of the suction holes 21*a*, select a print pattern based on the position information of the tablet T, and perform printing using the print pattern selected. With this, printing can be performed accurately on the tablets T by changing the print pattern according to the positional deviation of the conveyor belt 21. Thereby, the degradation of print quality can be suppressed. In addition, since it is possible to cope with the positional deviation of the conveyor belt 21 in the Y direction to some extent, the allowable range C2 can be expanded correspondingly.

Besides, the detection units 31 of the detecting device 30 described above can measure the separation distance between itself and the conveyor belt 21 by projecting and receiving laser beams while there is no tablet T on the conveyor belt 21. This enables to know a change in the height position (for example, waving) of the conveyor belt 21. For example, the control device 100 determines whether the height position of the conveyor belt 21 detected by the detection unit 31 is within an allowable range. Having determined that the height position of the conveyor belt 21 is within the allowable range, the control device 100 permits printing. Having determined that the height position of the conveyor belt 21 is out of the allowable range, the control device 100 prohibits printing in recognition of the position abnormality of the conveyor belt 21.

The above-described tablets may include tablets for pharmaceutical use, edible use, cleaning, industrial use, and aromatic use. Examples of the tablets include plain tablets (uncoated tablets), sugar-coated tablets, film-coated tablets, enteric coated tablets, gelatin coated tablets, multilayered tablets, dry-coated tablets, and the like. Examples of the tablet further include various capsule tablets such as hard capsules and soft capsules. The tablets may be in a variety of shapes such as, for example, a disk shape, a lens shape, a triangle shape, an oval shape, and the like. In the case where tablets to be printed are for pharmaceutical use or edible use, edible ink is suitably used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a supplier configured to supply a tablet;

a conveyor belt configured to convey the tablet supplied by the supplier;

a print head configured to perform printing on the tablet conveyed by the conveyor belt;

a belt-position detector configured to detect a position of the conveyor belt in a crossing direction, which crosses conveying direction of the tablet in a horizontal plane; and a controller, wherein the conveyor belt includes a plurality of holes arranged in a row along the conveying direction of the tablet, each configured to hold the tablet, the belt-position detector includes:

an imaging device configured to capture an image of two or more of the holes; and an image processing device configured to detect the position of the conveyor belt in the crossing direction based on the image captured by the imaging device, and the controller is configured to:

cause the imaging device to capture the image in a state where the supplier stops supplying the tablet;

cause the imaging processing device to detect the position of the conveyor belt based on the image captured by the imaging device in a state where the supplier stops supplying the tablet;

determine whether the position of the conveyor belt detected by the image processing device is within an allowable range; and cause the supplier to start the supply of the tablet when it is determined that the position of the conveyor belt detected by the image processing device is within the allowable range.

2. The tablet printing apparatus according to claim 1, wherein the imaging device is further configured to capture the image of the two or more of the holes while the conveyor belt is not moving, and the image processing device is further configured to detect an inclination degree of the conveyor belt with respect to the conveying direction of the tablet in the horizontal plane based on the image captured by the imaging device.

3. The tablet printing apparatus according to claim 1, wherein the imaging device is further configured to repeatedly capture the image of different ones of the holes while the conveyor belt is moving, and the image processing device is further configured to detect a weaving degree of the conveyor belt based on a plurality of images captured by the imaging device.

4. The tablet printing apparatus according to claim 1, wherein the imaging device is further configured to capture the image for either or both printing and print inspection.

5. The tablet printing apparatus according to claim 1, wherein the imaging device is configured to capture an image that indicates the position of the conveyor belt in the crossing direction, the tablet printing apparatus further comprising a display configured to display the image captured by the imaging device.

6. The tablet printing apparatus according to claim 1, wherein the imaging device includes a first imaging device located upstream of the print head in the conveying direction of the tablet and is configured to capture an image including an upper surface of the tablet conveyed by the conveyor belt, the imaging device is further configured to capture the image of the two or more of the holes by the first imaging device, and the image processing device is further configured to detect the position of the conveyor belt in the crossing direction based on the image captured by the first imaging device.

7. The tablet printing apparatus according to claim 1, wherein the imaging device includes a second imaging device located downstream of the print head in the conveying direction of the tablet and is configured to capture an image including an upper surface of the tablet conveyed by the conveyor belt after the print head has performed printing thereon, the imaging device is further configured to capture the image of the two or more of the holes by the second imaging device, and the image processing device is further configured to detect the position of the conveyor belt in the crossing direction based on the image captured by the second imaging device.

8. The tablet printing apparatus according to claim 1, wherein the imaging device includes:

a first imaging device located upstream of the print head in the conveying direction of the tablet and configured to capture an image including an upper surface of the tablet conveyed by the conveyor belt; and a second imaging device located downstream of the print head in the conveying direction of the tablet and configured to capture an image including the upper surface of the tablet conveyed by the conveyor belt after the print head has performed printing thereon, and the imaging device is further configured to capture the image of the two or more of the holes by either or both of the first imaging device and the second imaging device, and the image processing device is further configured to detect the position of the conveyor belt in the crossing direction based on the image captured by either or both of the first imaging device and the second imaging device.

9. The tablet printing apparatus according to claim 1, wherein the controller is further configured to cause the imaging device to capture images for one rotation of the conveyor belt while the conveyor belt is moving and determine whether the position of the conveyor belt is within the allowable range based on the images captured by the imaging device.

10. The tablet printing apparatus according to claim 6, wherein the controller is further configured to cause the imaging device to capture images for one rotation of the conveyor belt while the conveyor belt is moving and determine whether the position of the conveyor belt is within the allowable range based on the images captured by the imaging device.

11. The tablet printing apparatus according to claim 7, wherein the controller is further configured to cause the imaging device to capture images for one rotation of the conveyor belt while the conveyor belt is moving and determine whether the position of the conveyor belt is within the allowable range based on the images captured by the imaging device.

12. A tablet printing apparatus, comprising:

a conveyor belt configured to convey a tablet;

a print head configured to perform printing on the tablet conveyed by the conveyor belt; and a belt-position detector configured to detect a position of the conveyor belt in a crossing direction, which crosses a conveying direction of the tablet in a horizontal plane, wherein the conveyor belt includes a plurality of holes arranged in a row along the conveying direction of the tablet, each configured to hold the tablet, the belt-position detector includes:

an imaging device configured to capture an image of two or more of the holes; and an image processing device configured to detect the position of the conveyor belt in the crossing direction based on the image captured by the imaging device, the print head is further configured to perform the printing based on a predetermined print pattern, the tablet printing apparatus further comprising a controller configured to:

calculate a deviation amount by which the position of the conveyor belt in the crossing direction detected by the belt-position detector is deviated from a predetermined position;

change the predetermined print pattern based on the deviation amount calculated; and cause the print head to perform the printing based on the print pattern changed.

13. A tablet printing method for conveying a tablet supplied by a supplier by a conveyor belt and performing printing on the tablet by a print head, wherein the conveyor belt includes a plurality of holes arranged in a row along conveying direction of the tablet, each configured to hold the tablet, the tablet printing method comprising:

capturing an image of two or more of the holes by an imaging device in a state where the supplier stops supplying the tablet;

detecting a position of the conveyor belt in a crossing direction, which crosses conveying direction of the tablet in a horizontal plane, based on the image captured by the imaging device in a state where the supplier stops supplying the tablet by an image processing device;

determining whether the position of the conveyor belt detected by the image processing device is within an allowable range; and starting the supply of the tablet by the supplier when it is determined that the position of the conveyor belt detected by the image processing device is within the allowable range.

14. The tablet printing method according to claim 13, further comprising:

capturing an image that indicates the position of the conveyor belt in the crossing direction by the imaging device when detecting the position of the conveyor belt in the crossing direction; and displaying the image captured by the imaging device on a display.

* * * * *